United States Patent [19]

Mikoshiba et al.

[11] 4,152,982

[45] May 8, 1979

[54] MINIATURE PRINTER

[75] Inventors: Hitoshi Mikoshiba; Chikao Tezuka, both of Shiojiri, Japan

[73] Assignees: Kabushiki Kaisha Suwa Seikosha, Tokyo; Shinshu Seiki Kabushiki Kaisha, Suwa, both of Japan

[21] Appl. No.: 817,778

[22] Filed: Jul. 21, 1977

[30] Foreign Application Priority Data

Jul. 21, 1976 [JP] Japan ..... 51-86750

[51] Int. Cl.[2] ..... B41J 1/44

[52] U.S. Cl. ..... 101/93.22; 101/99; 74/435

[58] Field of Search ..... 101/93.22, 95, 96, 99, 101/110; 74/84, 664, 325, 435

[56] References Cited

U.S. PATENT DOCUMENTS

| | | | |
|---|---|---|---|
| 3,309,988 | 3/1967 | Touchman | 101/93.22 |
| 3,505,950 | 4/1970 | Harper | 101/93.22 |
| 3,654,859 | 4/1972 | Touchman | 101/93.22 |
| 3,846,681 | 11/1974 | Arhan et al. | 101/93.22 X |
| 3,882,735 | 5/1975 | Shimodaira et al. | 101/110 X |
| 3,884,144 | 5/1975 | Shimodaira | 101/99 |
| 3,967,550 | 7/1976 | Busch | 101/93.22 X |
| 4,033,256 | 7/1977 | Hanaoka | 101/99 |

FOREIGN PATENT DOCUMENTS

| | | | |
|---|---|---|---|
| 2259988 | 7/1972 | Fed. Rep. of Germany | 101/93.22 |

*Primary Examiner*—Edward M. Coven

*Attorney, Agent, or Firm*—Blum, Moscovitz, Friedman & Kaplan

[57] ABSTRACT

A miniature printer especially for use in a small calculator or the like, of the type in which a plurality of character wheels are carried on a rotating drive shaft. The speed of rotation of the drive shaft can be varied so that its speed during character selection is different from that during the resetting of the character wheels.

22 Claims, 7 Drawing Figures

MINIATURE PRINTER

BACKGROUND OF THE INVENTION

This invention relates generally to a miniature printer and especially to a printer utilized in electronic table calculators, pocket calculators and the like. In the art, such printers utilize a number of character wheels mounted to a rotating drive shaft. During a first rotation of the shaft the character wheels are stopped at their desired character by selection means after which printing takes place. The character wheels are reset to their original position during a second rotation of the drive shaft. Such printers have generally rotated the drive shaft at the same rotary speed during the character selection and resetting processes. This constant speed of rotation creates a number of problems especially where high speed printing is involved. If high speed printing is desired either reliability of operation must be sacrificed or large amounts of power must be input to overcome these problems. The instant invention is directed to a miniature printer which overcomes these difficulties without sacrificing reliability of operation or requiring large inputs of power.

SUMMARY OF THE INVENTION

Generally speaking, a miniature printer especially suitable for use in small calculators is provided. The printer is of the type in which a plurality of character wheels are mounted to a rotary drive shaft. During a first rotation of the drive shaft the characters to be printed are selected by selection means and thereafter the printing takes place, after which a second rotation of the drive shaft takes place to reset the character wheels to their original position. The instant invention is directed to a printer in which the drive means permit the drive shaft to rotate at a first rotary speed during the character selection process, to be stopped during the printing process and to rotate at a second rotary speed during the resetting process. The drive motor continues to run at a constant speed during the selection, printing and resetting processes.

Accordingly, it is an object of the invention to provide an improved miniature printer capable of high speed operation.

Another object of the invention is to provide an improved miniature printer whose operation is reliable even when operated at a high printing speed.

Yet another object of the invention is to provide an improved printer in which the speed of rotation of the character wheel drive shaft may be varied during the character selection and resetting processes.

Still another object of the invention is to provide an improved miniature printer which allows the drive shaft rotating the character wheels to be stopped during the printing process without requiring that the drive motor be stopped.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
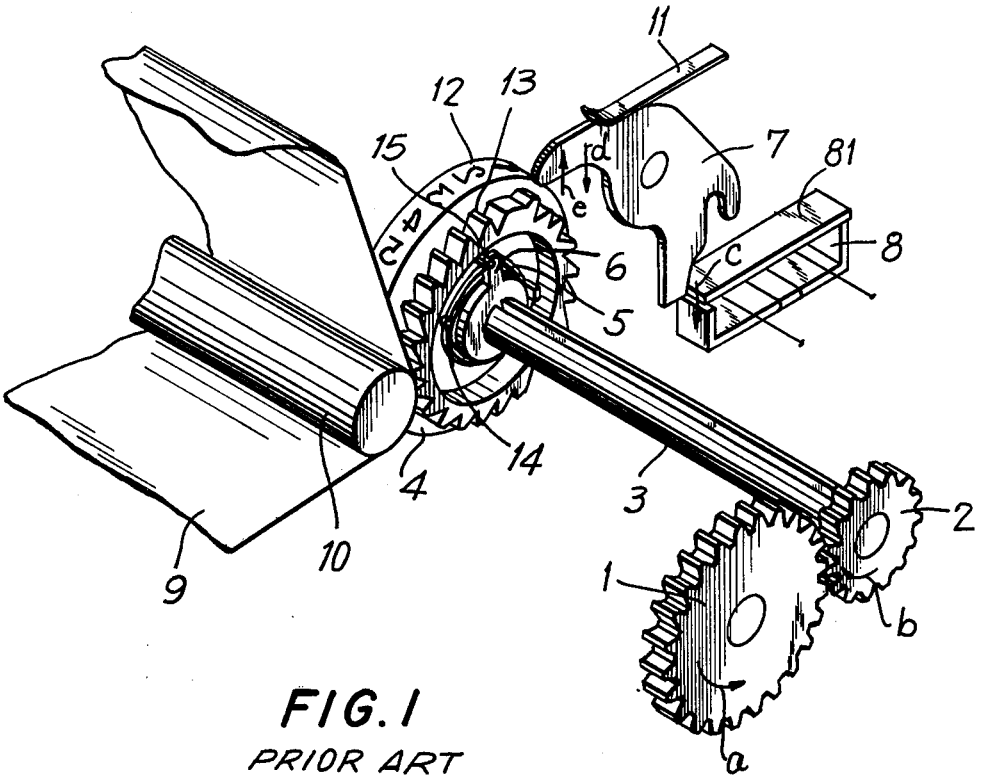
FIG. 1 PRIOR ART
FIG. 1 is a perspective view of a conventional miniature printer utilizing character wheels mounted to a rotary drive shaft.

FIG. 1 illustrates a conventional miniature printer including a driving gear 1 in mesh with a driven gear 2 which is mounted to a drive shaft 3. The conventional printer includes a number of character wheels 4, one of which is illustrated, each having characters 12 disposed about their periphery. Character wheel 4 is coupled to drive shaft 3 by means of a spring 5 which has one end hooked to a plate 6 secured to drive shaft 3 and the other end secured to a pin 14 disposed on character wheel 4. A selecting pawl 7 selectively engages with the teeth of a ratchet wheel 13 provided on character wheel 4 for selecting a character 12 to be printed. Pawl 7 is pivotally mounted and biased in the direction of engagement with the teeth of ratchet wheel 13 by means of a spring 11. Plate 81 normally holds pawl 7 out of such engagement. An electromagnet 8, when energized, displaces plate 81 to release pawl 7 for pivotal displacement into engagement with the teeth of ratchet wheel 13. Means (not shown) returns pawl 7 to its rest position in engagement with plate 81. A web of paper 9 which is to be printed upon, is disposed between a print hammer 10 and the characters 12 carried on character wheel 4.

In operation, gear 1 is rotated in direction a which rotates gear 2 and drive shaft 3 in direction b. Since character wheel 4 is coupled to drive shaft 3 by means of spring 5 it will also rotate. When a character 12 desired to be printed comes to a position opposed to that of print hammer 10, current will be conducted to electromagnet 8 to move plate 81 engaged with pawl 7 in direction c, which will cause the other end of pawl 7 to move in direction d. Pawl 7 will thus engage a selected tooth of ratchet wheel 13 and will cause it and character wheel 4 to stop rotating at a selected position. Drive shaft 3 will continue to rotate and will thus wind spring 5 up. During one turn of drive shaft 3 each of the character wheels 4 will be stopped from rotating at a selected position by means of their respective pawls 7 and the character selection process will be completed. Thereafter, print hammer 10 will impress the character upon the paper web 9. In the meantime, drive shaft 3 will continue to rotate.

After the printing process is completed, a resetting process in order to return the character wheels 4 to its original position and alignment will take place. This resetting process will take place during approximately one further rotation of drive shaft 3. A this time, pawl 7 will be displaced in direction e by means not shown to disengage it from the teeth of ratchet wheel 13. As pawl 7 is disengaged the spring action of spring 5 will rotate character wheel 4 until a pin 15 provided on it abuts with plate 6, as this occurs each of the character wheels 4 will be returned to their original aligned position and one printing cycle will have been completed.

Figure 2:
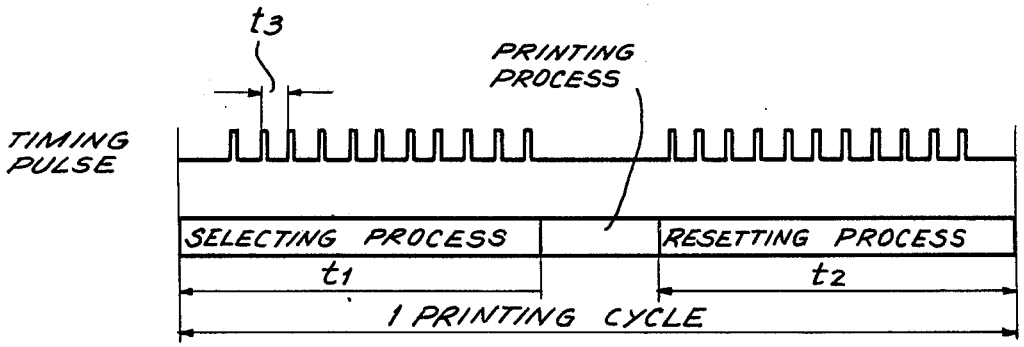
FIG. 2 PRIOR ART
FIG. 2 is a timing chart showing the printing cycle of the conventional printer as shown in FIG. 1.

FIG. 2 shows a timing chart for the conventional printer, showing the timing pulses produced in synchronization with the movement of drive shaft 3, and which pulses represent the angular position of the characters 12 disposed about the periphery of character wheels 4. As noted above, the selection process and printing process each take about one revolution of drive shaft 3. Time $t_1$ is the time of the printing process, time $t_2$ is the time of the resetting process and time $t_3$ is the period of the timing pulses.

In order to shorten the entire printing cycle of the prior art device it was necessary to increase the rotational speed of drive shaft 3 which would shorten the period time $t_3$. Such increased speed necessitated that the electromagnet 8 operate at increased speed to activate pawl 7 and stop character wheels 4, which leads to inaccurate and unreliable operation. In order to increae the accuracy of the selection process where the $t_3$ time is shortened, it is necessary to increase the power of electromagnet 8, which increases the size of the printer and requires a larger energy input.

The conventional construction also contains a further problem in that when character wheel 4 is stopped by the action of pawl 7 and during activation of print hammer 10 drive shaft 3 is continuously rotating. This rotation puts a heavy frictional load on drive shaft 3 which requires larger parts and greater energy to overcome. The present invention is directed to an improved construction which overcomes these defects.

Figure 3:
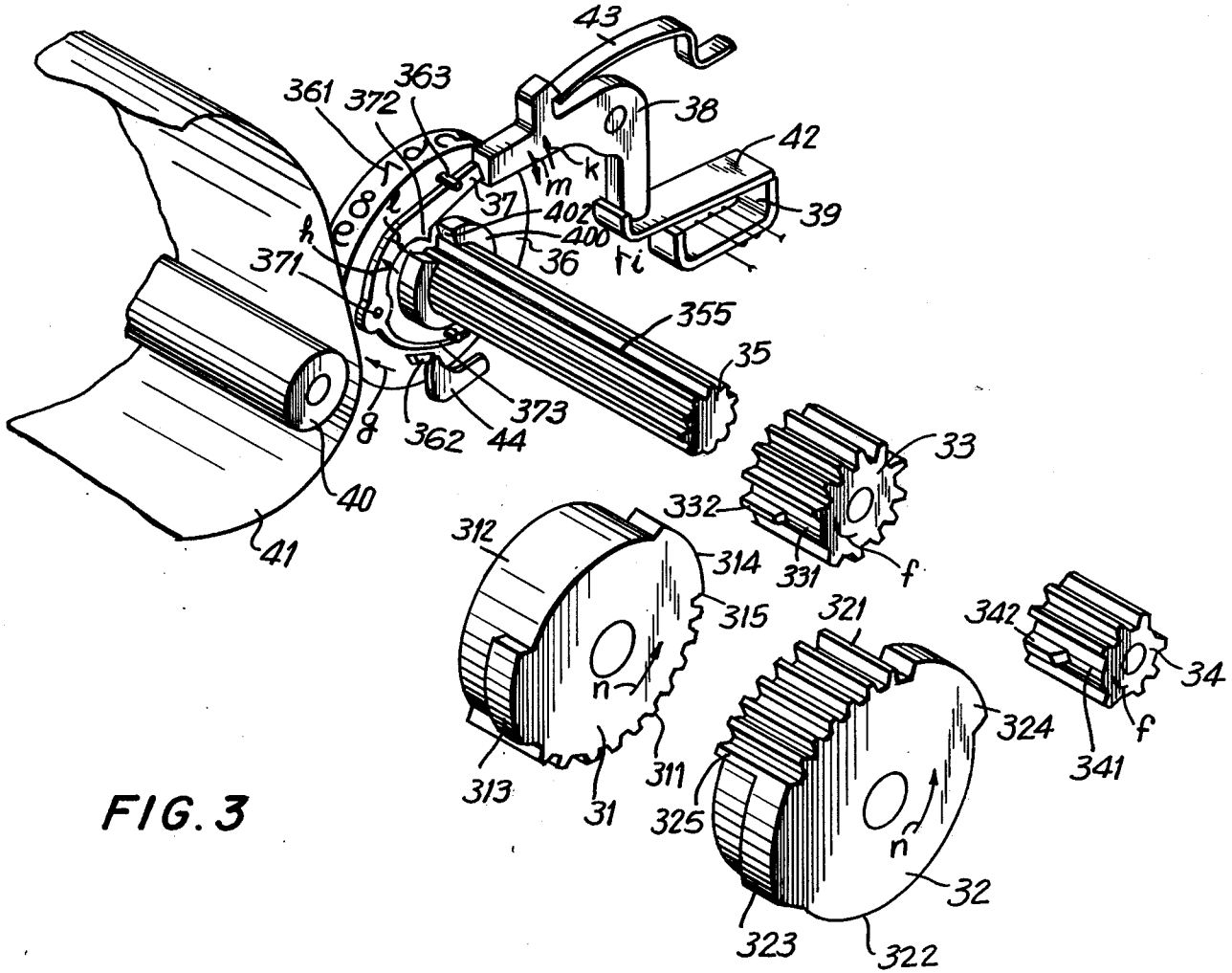
FIG. 3 is a perspective partially exploded view of a miniature printer constructed in accordance with a preferred embodiment of the instant invention.

FIG. 3 illustrates the driving and selecting mechanism of a miniature printer constructed in accordance with the instant invention. A first driving gear 31 is provided with a toothed portion 311, an untoothed portion 312 and circular projections 313 and 314. Toothed portion 311 and untoothed portion 312 extends along the entire transverse periphery of gear 31 while circular projections 313 and 314 extend only partially across said periphery. The height of circular projections 313, 314 is equal to that of toothed portion 311. A second driving gear 32 is formed with a toothed portion 321, untoothed portion 322 and circular projections 323 and 324, said circular projections extending partially across the lateral periphery of gear 32. Second driving gear 32 differs from that of first driving gear 31 in that the outer diameter of the toothed portion 321 of second driving gear 32 is larger than that of toothed portion 311 of first driving gear 32.

A first driven gear 33 is driven by first driving gear 31. Gear 33 has a toothed portion 332 and an untoothed portion 331, said untoothed portion 331 extending in the transverse direction of 33 an amount sufficient to mate with circular projections 313 and 314 of gear 31. Similarly, a second driven gear 34 driven by second driving gear 32 has a toothed portion 342 and an untoothed portion 341. Untoothed portion 341 extends in the transverse direction a sufficient distance to mate with circular projections 323 and 324 of gear 32.

Driving gears 31 and 32 may be secured to each other or formed as an integral unit. Similarly, driven gears 33 and 34 may also be secured together or formed as an integral unit. For the sake of clarity, in FIG. 3, gears 31, 33, 32 and 34 have been shown out of mesh, although they are in meshing engagement.

Secured to and driven by driven gears 33 and 34 is a drive shaft 35 which has a number of grooves 355 about its outer periphery, grooves 355 correspond in number to the number of characters 361 disposed on each character wheel 36 mounted to shaft 35. A number of character wheels 36 are provided, although only one is shown in the drawing. The number of character wheels 36 corresponds to the number of columns desired to be printed. For the sake of clarity the operation of only one character wheel 36 and its selection mechanism will be described which will suffice to describe the operation of all of the character wheels 36 and their selection mechanisms.

Each character ring 36 includes a collar 400 which surrounds and rotatably mounts character wheel 36 to drive shaft 35. Pivotally mounted on each character ring 36 is a pawl 37 which is pivoted at a pin 371. Pawl 37 includes a spring portion 373 which biases pawl 37 in direction 1. Pawl 37 includes a projection 372 which is insertable through an opening 402 in collar 400 and which serves to fixedly secure character wheel 36 to drive shaft 35 when projection 372 engages a selected one of the grooves 355 on drive shaft 35. A pin 363 serves to limit the pivotal displacement of pawl 37. Pawl 37 is so mounted as to be engageable with a pivotal trigger lever 38 for controlling the engaging and disengaging of projection of 372 from the grooves 355 of shaft 35 as will hereinafter be more fully described. Trigger level 38 is biased in direction k by means of spring 43 and is held against displacement by a magnetically permeable plate 42 mounted for attraction in direction i by an electromagnet 39 to release said trigger lever.

Figure 4:
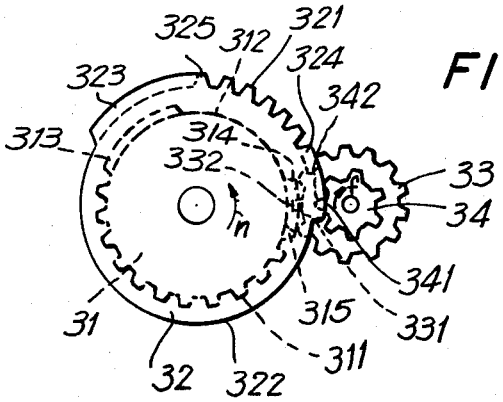
FIG. 4 is a side elevational view of the drive gears of the instant invention in their locked condition.
Figure 5:
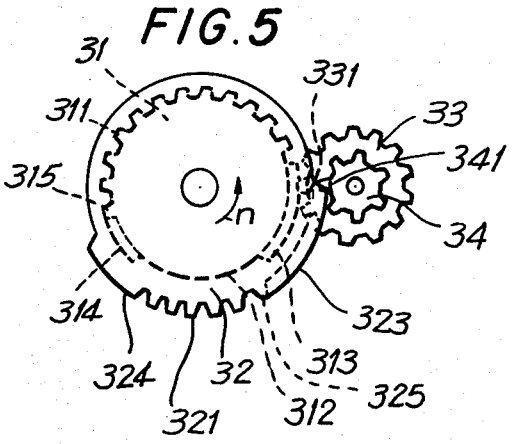
FIG. 5 is a side elevational view of the drive gears of the instant invention at the end of the character selection process.
Figure 6:
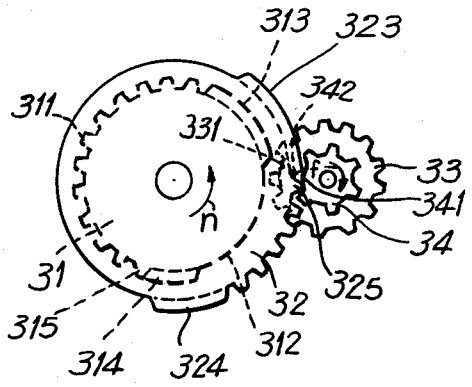
FIG. 6 is a side elevational view of the drive gears of the instant invention at the beginning of the resetting process.

The operation of the miniature printer may be seen from reference to FIGS. 4, 5 and 6. FIG. 4 illustrates a locked, or standby condition of the gear train in which circular projection 314 of first driving gear 31 is located within the non-toothed portion 331 of the first driven gear 33. Similarly, circular projection 324 of second driving gear 32 is located in non-toothed portion 341 of the second driven gear 34. In this condition, the circular projections abut the teeth of the toothed portion of driven gears 33 and 34 and thus hold driven gears 33 and 34 in an unmoving position even though driving gears 31 and 32 continue to rotate. This locked condition will continue for so long as the circular projection portions 314 and 331 of the driving gears 31 and 32 are engaging the cut-off portions 331 and 341 of gears 33 and 34 respectively.

As gears 31 and 32 continue to rotate in direction n the untoothed portion 322 of driving gear 32 will approach the teeth of driven gear 34. However, since portion 322 is untoothed no driving will occur. Simultaneously, the first tooth 315 of toothed portion 311 of first driving gear 31 will begin to mesh with the toothed portion 332 on first driven gear 33 and will thus cause gear 33 and drive shaft 35 to rotate in direction f. This rotation will continue until the gear train assumes the condition shown in FIG. 5 which will rotate gear 33 and drive shaft 35 through a complete revolution during which time the selection process described below will take place.

The selection process begins with each of the character wheels 37 in the position shown in FIG. 3, that is, with projection 372 on pawl 37 out of engagement with the grooves 355 of drive shaft 35 so that even if drive shaft 35 is being driven, no rotation of character wheel 36 occurs. Tigger lever 38 locks pawl 37 in this disengaged condition and alignment projection 362 is in engagement with a positioning member 44 which is biased into engagement with alignment projection 362 by spring means (not shown).

Figure 7:
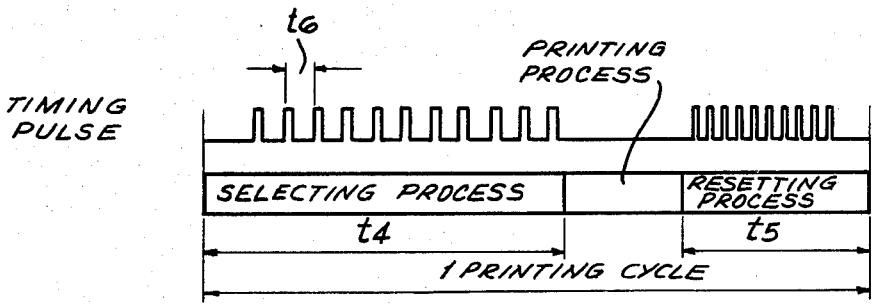
FIG. 7 is a timing chart showing the printing cycle of a printer constructed in accordance with the instant invention.

The character alignment process is as follows, as drive shaft 35 rotates a series of timing pulses, shown in FIG. 7, are generated by conventional means (not shown). Each timing pulse corresponds to one of grooves 355 in drive shaft 35 which in turn corresponds to one of characters 361 disposed about the periphery of character wheel 36. In order to align a row of characters 361, when the corresponding groove 355 on drive shaft 35 approaches projection 372 on pawl 37 electromagnet 39 will be energized which will cause plate 42 to be displaced in direction i which will cause trigger lever 38 to be displaced in direction k by means of spring 43 thus releasing pawl 37 from trigger lever 38. Pawl 37 will then be pivoted by means of spring 373 in direction l and projection 372 will engage the corresponding groove 355 on drive shaft 35 to cause character wheel 36 to be fixed relative to and to rotate along with drive shaft 35. The selection process is completed when all of the character wheels 36 have been engaged for rotation with drive shaft 35.

After the selection process is completed, the gear train will be in the position illustrated in FIG. 5 in which first driving gear 31 will have rotated first driven gear 33 through a complete revolution. Circular projection 313 of first driving gear 31 will be in engagement with the non-toothed portion 331 of first driven gear 33 to lock gear 33 against rotation. Additionally, circular projection 323 of second driving gear 32 will be within the non-toothed portion 341 of second drive gear 34 to lock same. Thus, even though driving gears 31 and 32 continue to rotate in direction n, driven gears 33 and 34 and thus drive shaft 35 and character wheel 36 will also be locked against rotation. At this time, a print hammer 40 will be actuated to print the selected characters upon a paper web 41, there being no additional drag on driving gears 31 and 32.

After printing has been completed, the resetting of the character wheels will take place. FIG. 6 illustrates the position of the gear at the beginning of the resetting process, as first driving gear 31 continues to rotate, circular projections 313 and 323 will move away from and release from locking both first driven gear 33 and second driven gear 34 upon further rotation of first driving gear 31, no further driving of first driven gear 33 will take place since untoothed portion 312 of first driving gear 31 will not engage the teeth 332 of first driven gear 33. However, the first tooth 325 of toothed portion 321 of second driving gear 33 will be moved into engagement with the teeth 342 of second driving gear 34 upon such further rotation and drive shaft 35 will be rotated in direction f by means of second gears 32 and 34. This rotation will continue for one full revolution until the gears are in the condition shown in FIG. 4 and during this time the resetting and alignment of the character wheels 36 will take place.

During resetting, trigger lever 38 will be displaced in direction m by conventional means (not shown) and will again engage and be held by plate 42. As shaft 35 and the respective character wheel 36 continue to rotate, each pawl 37 will eventually abut and contact the associated trigger lever 38. This contact will cause each pawl 37 to rotate in direction h about pin 371 until the engagement of its projection 372 with a groove 355 of drive shaft 35 is released. At the end of the resetting process all of the character wheels are aligned as shown in FIG. 3 with positioning member 44, which is biased toward drive shaft 35, engaged behind alignment projection 362 so as to force pawl 37 against pin 363 and trigger lever 38 against the force of spring portion 373. Positioning member 44 cams along a surface of alignment projection 362 for positioning character wheel 38 by rotating the same in direction g. This completes the resetting and alignment process.

After the resetting and alignment processes are completed one printing cycle will have been completed. As noted above, drive shaft 35 is rotated in the selecting process by way of the engagement of first driving gear 31 with first driven gear 33 and in the resetting and alignment process by the engagement between second driving gear 32 and second driven gear 34. However, since the gear ratios between first gears 31 and 32 and second gears 33 and 34 are different, drive shaft 35 will be rotated more rapidly during the driving between second gears 32 and 34.

As shown in FIG. 7 this permits the time $t_5$ of the resetting process to be shortened in comparison to the time $t_4$ of the selection process without having to shorten the time $t_6$ between each of the timing pulses during the selection process.

The above described construction permits the printing cycle to be shortened by merely varying the resetting time without affecting the selection time which makes an overall high speed printing cycle possible. Furthermore, since the selection time is relatively longer with respect to the total printing cycle the time $t_6$ between pulses can be made longer which permits the activation of the electromagnet to be made over a longer period of time which insures greater reliability as well as allowing the electromagnet itself to be made smaller. The timing pulse illustrated in FIG. 7 is emitted synchronously with the movement of drive shaft 35 and is used to control the timing of the current activating electromagnet 39 in a conventional manner. Furthermore, in this construction during the time of the activation of print hammer 40, drive shaft 35 will not be rotating so that lesser energy is utilized during the printing process and frictional losses are minimized. Thus, the instant invention provides a miniature printer having high printing speed, good reliability and energy efficiency.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A miniature printer for printing a web of paper comprising a rotatable drive shaft; a plurality of character wheels rotatably mounted on said drive shaft, each of said character wheels having a plurality of characters disposed about its periphery; means for selecting a single said character on each of said character wheels for printing on said paper, and for resetting said character wheels to a reset position after printing, said selecting and resetting means including means for selectively coupling said drive shaft and each said character wheel, and means for rotating said drive shaft during selection of a character and resetting of said character wheels, said rotating means being gear means adapted to rotate said drive shaft at a first rotary speed during said character selection and at a second rotary speed different from said first rotary speed during said resetting of said character wheel; and means for effecting printing of said selected characters on said paper between such selection and resetting.

2. A miniature printer as claimed in claim 1, wherein said drive shaft is driven in only a single direction and said second rotary speed is greater than that of said first rotary speed.

3. A miniature printer as claimed in claim 2, wherein said rotating means is adapted to stop the rotation of said drive shaft and character wheels during the operation of said printing means.

4. A miniature printer as claimed in claim 1, wherein said gear means include a first driving gear and a first driven gear, said first driven gear being operatively coupled to said drive shaft for rotation thereof in response to the rotation of said first driven gear, said first driving gear having a non-toothed portion, a toothed portion and at least one circular projection equal in radius to the toothed portion, said first driven gear including a toothed portion and a non-toothed portion corresponding to said circular projection on said first driving gear, said first driving gear rotatably driving said first driven gear when said toothed portion of said first driving gear is in engagement with said toothed portion on said first driven gear, said first driving gear not driving said first driven gear when said untoothed portion of said first driving gear is proximate to said first driven gear and said first driving gear locking said first driven gear against rotation when said circular projection is in engagement with said non-toothed portion of said first driven gear.

5. A miniature printer as claimed in claim 4, further including a second driving gear and a second driven gear, and said second driven gear being operatively coupled to said drive shaft for rotation thereof in response to rotation of said second driven gear, said second driving gear including a non-toothed portion and at least one circular projection equal in radius to said toothed portion, said second driven gear including a toothed portion and a non-toothed portion corresponding to said circular projection on said second driving gear, said second driving gear rotatably driving said second driven gear when said toothed portion of said second driving gear is in engagement with said toothed portion of said second driven gear, said second driving gear not driving said second driven gear when said untoothed portion of said second driving gear is proximate to said second driven gear, said second driving gear locking said second driven gear against rotation when said circular projection on said second driving gear is in engagement with said non-toothed portion of said second driven gear.

6. A miniature printer as claimed in claim 5, wherein said first and second driving gears are coupled for synchronous rotation and said toothed portion of said first driving gear corresponds in angular position to said untoothed portion of said second driving gear and said toothed portion of said second driving gear corresponds in angular position to said untoothed portion of said first driving gear.

7. A miniature printer as claimed in claim 6, wherein said first and second driving gears further include a second circular projection, said respective second circular projections and said first circular projections on said first and second driving gears corresponding in angular position to each other and being respectively positioned on opposed sides of the toothed portions of said driving and driven gears.

8. A miniature printer as claimed in claim 5, wherein the diameter of said toothed portion of said second driving gear is greater than that of said toothed portion of said first driving gear.

9. A miniature printer as claimed in claim 8, wherein the diameter of the toothed portion of said first driven gear is greater than that of the toothed portion of said first and second driving gears and said first and second driven gears being respectively coaxially mounted.

10. A miniature printer as claimed in claim 9, wherein the respective toothed and non-toothed portions of said first and second driven gears are aligned with each other, the rotation of said drive shaft is stopped when one of said first and second circular projections of said first and second driving gears are proximate the non-toothed portions of said first and second driven gears.

11. A miniature printer as claimed in claim 10, wherein said non-toothed portions of said first and second driven gears occupy only a transverse portion of the periphery of said first and second driven gears, said first and second circular projections occupying a corresponding transverse portion of the periphery of said first and second driving gears.

12. A miniature printer as claimed in claim 1, wherein said coupling means comprises pawl means mounted to each said character wheel, said pawl means having a first position in which said character wheel is coupled for rotation with said drive shaft, said pawl means having a second position in which said character wheel is freely rotatable about said drive shaft, said coupling means further comprising triggering means mounted externally of coupling means, said triggering means coacting with said pawl means for displacing said coupling means between said first position to said second position.

13. A miniature printer as claimed in claim 13, wherein said drive shaft includes a series of grooves corresponding to said plurality of characters disposed on said character wheels, said pawl means including a projection for engagement with said grooves on said drive shaft, said projection on said pawl means engaging a selected groove of said drive shaft means when said pawl means is in said first position, said projection being disengaged with said groove when said pawl means is in said second position.

14. A miniature printer as claimed in claim 13, wherein each said pawl means is biased toward the first position thereof.

15. A miniature printer as claimed in claim 13, wherein said character wheel further includes a collar surrounding said drive shaft and an opening in said collar, said projection on said pawl means being insertable through said collar when said projection is in engagement with said groove.

16. A miniature printer as claimed in claim 12, wherein each said character wheel includes an alignment projection, said coupling means including a positioning means associated with and mounted externally of each said character wheel, said alignment projection coacting with the associated positioning means for positioning said character wheel in a reset position during resetting.

17. A miniature printer as claimed in claim 12, wherein said trigger means comprise a pivotally mounted trigger lever and means for selectively pivoting said trigger lever in and out of engagement with said pawl means.

18. A miniature printer as claimed in claim 17, wherein said means for pivoting said trigger lever comprises electromagnet means.

19. A miniature printer for printing a web of paper comprising a rotatable drive shaft; a plurality of character wheels rotatably mounted on said drive shaft, each said character wheel having a plurality of characters disposed about its periphery; means for selecting a single said character on each of said character wheels for printing on said paper, and for resetting said character wheels to a reset position after printing, said selecting and resetting means including means for selectively coupling said drive shaft and each said character wheel, and means for rotating said drive shaft during selection of a character and resetting of said character wheels; and means for effecting printing of said selected characters on said paper between such selection and resetting, said coupling means including pawl means mounted to each said character wheel, said pawl means having a first position in which said character wheel is coupled for rotation with said drive shaft, said pawl means having a second position in which said character wheel is freely rotatable about said drive shaft said coupling means further including triggering means mounted externally of said coupling means, said triggering means coacting with said pawl means for displacing said coupling means between said first position and said second position, said drive shaft being formed with a series of grooves corresponding to said plurality of characters disposed on said character wheels, said pawl means including a projection for engagement with said grooves on said drive shaft, said projection on said pawl means engaging a selected groove of said drive shaft means when said pawl means is in said first position, said projection being disengaged with said groove when said pawl means is in said second position.

20. A miniature printer as claim in claim 19, wherein each said pawl means is biased toward the first position thereof.

21. A miniature printer as claimed in claim 19, wherein said character wheel further includes a collar surrounding said drive shaft and an opening in said collar, said projection on said pawl means being insertable through said collar when said projection is in engagement with said groove.

22. A miniature printer for printing a web of paper comprising a rotatable drive shaft; a plurality of character wheels rotatably mounted on said drive shaft, each said character wheel having a plurality of characters disposed about its periphery and an alignment projection; means for selecting a single said character on each of said character wheels for printing on said paper, and for resetting said character wheels to a reset position after printing, said selecting and resetting means including means for selectively coupling said drive shaft and each said character wheel, and means for rotating said drive shaft during selection of a character and resetting of said character wheels; and means for effecting printing of said selected characters on said paper between such selection and resetting; said coupling means including pawl means mounted to each said character wheel, said pawl means having a first position in which said character wheel is coupled for rotation with said drive shaft, said pawl means having a second position in which said character wheel is freely rotatable about said drive shaft said coupling means further including triggering means mounted externally of said coupling means, said triggering means coacting with said pawl means for displacing said coupling means between said first position and said second position; and a positioning means associated with and mounted externally of each said character wheel, said alignment projection coacting with the associated positioning means for positioning said character wheel in a reset position during resetting.

* * * * *